US007194782B1

(12) United States Patent
Lewis

(10) Patent No.: US 7,194,782 B1
(45) Date of Patent: Mar. 27, 2007

(54) WEARABLE GARMENT THAT DISPENSES MULTIPLE CLEANING SOLUTIONS AND VACUUM RESIDUAL WASTE FLUIDS

(75) Inventor: Jean Lewis, Manassas, VA (US)

(73) Assignee: Outside the Box Inventions, LLC., Manassas, VA (US)

( * ) Notice: Subject to any disclaimer, the term of this patent is extended or adjusted under 35 U.S.C. 154(b) by 645 days.

(21) Appl. No.: 10/602,107

(22) Filed: Jun. 24, 2003

(51) Int. Cl.
*A47L 11/30* (2006.01)

(52) U.S. Cl. ..... 15/321; 15/327.5

(58) Field of Classification Search ..... 15/321, 15/327.5, 353; D32/21; 2/114, DIG. 3, 2/DIG. 5
See application file for complete search history.

(56) References Cited

U.S. PATENT DOCUMENTS 3,165,774 A * 1/1965 Barba ..... 15/323
3,331,090 A * 7/1967 Reiber et al. ..... 15/321
D344,632 S * 3/1994 Owens ..... D4/115
5,836,046 A * 11/1998 Huffman et al. ..... 15/321
6,305,048 B1 * 10/2001 Salisian ..... 15/326
6,568,026 B2 * 5/2003 Roy et al. ..... 15/327.5
2001/0049854 A1 * 12/2001 Dalbey ..... 15/321
2002/0124294 A1 * 9/2002 McKenzie et al. ..... 2/69

FOREIGN PATENT DOCUMENTS

DE 2713995 * 10/1977
FR 7411914 * 11/1975

* cited by examiner

*Primary Examiner*—Terrence R. Till

(57) ABSTRACT

An adjustable garment made to contain multiple bladder reservoirs for holding liquid cleaning agents and a separate cordless mechanism for producing a vacuum under wet or dry conditions. The liquid cleaning agents in the bladders can be selected via a knob on the garment. After the specified cleaning solution is selected, it then flows through a hose into a spray gun, which disseminates it onto a surface.

2 Claims, 2 Drawing Sheets

WEARABLE GARMENT THAT DISPENSES MULTIPLE CLEANING SOLUTIONS AND VACUUM RESIDUAL WASTE FLUIDS

CROSS REFERENCE TO RELATED APPLICATIONS

Not applicable.

REFERENCE TO SEQUENCE LISTING A TABLE OR COMPUTER PROGRAM LISTING COMPACT DISK APPENDIX

Not applicable

BACKGROUND OF THE INVENTION

Industrial and household surface cleaning is an undesirable but necessary function requiring repetitive and wasted motion. Depending on the variety of surfaces and stains encountered during cleaning, many different types of cleaning solutions are needed to effectively clean them. Thus, specific products must be located, adjusted to the proper spray application, and then sprayed on the surface to be cleaned. Once the solution is sprayed on the surface, the solution dissolves the stains, which are then both manually removed from the surface. This process involves repeated motions that can be frustrating to the person who is using them; particularly if the correct type of cleaning agent was not selected initially or if the absorbent material to remove the solution was not readily available. A garment that contains all the necessary types of cleaning solutions for stains encountered will save time and effort. Additionally, instead of using towels, rags, sponges, or some other absorbent materials to remove the residual waste from the surface, a mechanism to vacuum up residual waste would further make the cleaning chore more efficient.

BRIEF SUMMARY OF THE INVENTION

The previously mentioned objects and others are achieved by the present invention, which is directed to a device to improve the task of cleaning household or industrial surfaces. In particular, the device involves the delivering of a cleaning solution which is selected or combined from a variety of solutions that are contained in separate reservoirs located within the structure of the cleaning garment.

According to the invention, cleaning solutions are located in bladder reservoirs and are attached to a garment that can be comfortable worn. A selector dial is used to choose which cleaning solution or solutions will be delivered to the distal spray gun that is connected via a hose to the selector dial. Multiple attachments including those for scrubbing, sponging, or swabbing can be attached to the spray gun head.

After cleaning solution is applied, and the surface is scrubbed if necessary, the residual waste solution is then removed by the aforementioned wet-dry vacuum device, which is also manufactured as part of the garment. A liquid waste reservoir conveniently holds all cleaning solution waste until it can be disposed.

DETAILED DESCRIPTION OF THE INVENTION

There is no prior development of an invention similar to that described herein. In the following detailed description, reference is made to the accompanying drawings which are shown by way of illustration of specific embodiments in which the invention may be practiced. It is to be understood that other embodiments may be utilized and structural or logical changes may be made without departing from the scope of the present invention. The following detailed description, therefore, is not to be taken in a limiting sense, and the scope fo the present invention is defined by the appended claims.

Figure 1:
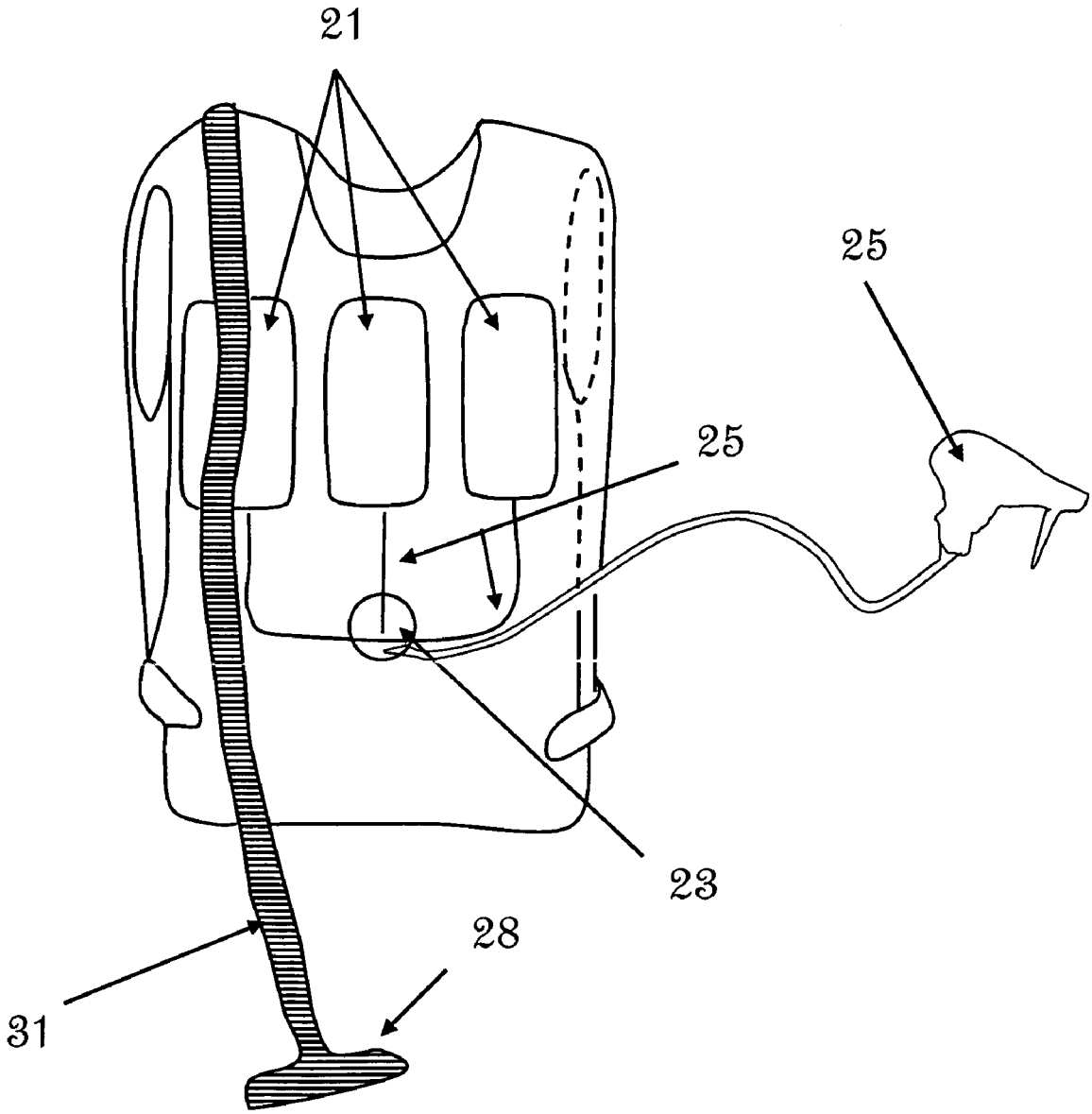
FIG. 1 Front view of the invention

FIG. 1 illustrates a preferred embodiment of a garment containing reservoirs to disperse cleaning solutions and a vacuum designed to pick up liquid waste.

Garment (FIG. 1). The invention is a garment (29) composed of natural or synthetic fabric and can be made as a coat, vest, over shirt, etc, that allows it to be comfortable worn by the user. The cleaning solution reservoirs; control knob; tubes, and vacuum are all directly attached to the garment. By way of example, a single adjustment device is shown, however a variety of closures can be used to adjust the garment, including, but not limited to Velcro, ties, straps, buckles, etc.

Solution reservoirs (21). Several bladder reservoirs (21), capable of holding various cleaning solutions are attached to the garment. These bladders are made of a durable, flexible material, such as vinyl, capable of holding the cleaning solutions without leaking. In FIG. 1, three reservoirs are depicted; however, a number of bladders can be attached to the garment. In order to facilitate cleaning of the reservoirs, they can be removable or permanently integrated into the garment. A variety of cleaning solutions can be used in the bladder reservoirs, including, but not limited to those used to clean windows, anti-bacterial, anti-grease, anti-scum, water, etc.

Dial (23) The cleaning solution is selected via a selector dial (23) located in an easy to reach location on the garment. The selector dial allows one or more solutions to be taken into the tube at a time and delivered to the spray nozzle. Once the selection is made, liquid is dispensed through the imbedded tubes (22) and through the attachment (25). As depicted, the attachment (25) can be a spray nozzle; however other types of attachments that scrub, sponge, or perform a cleaning function can be contemplated.

Figure 2:
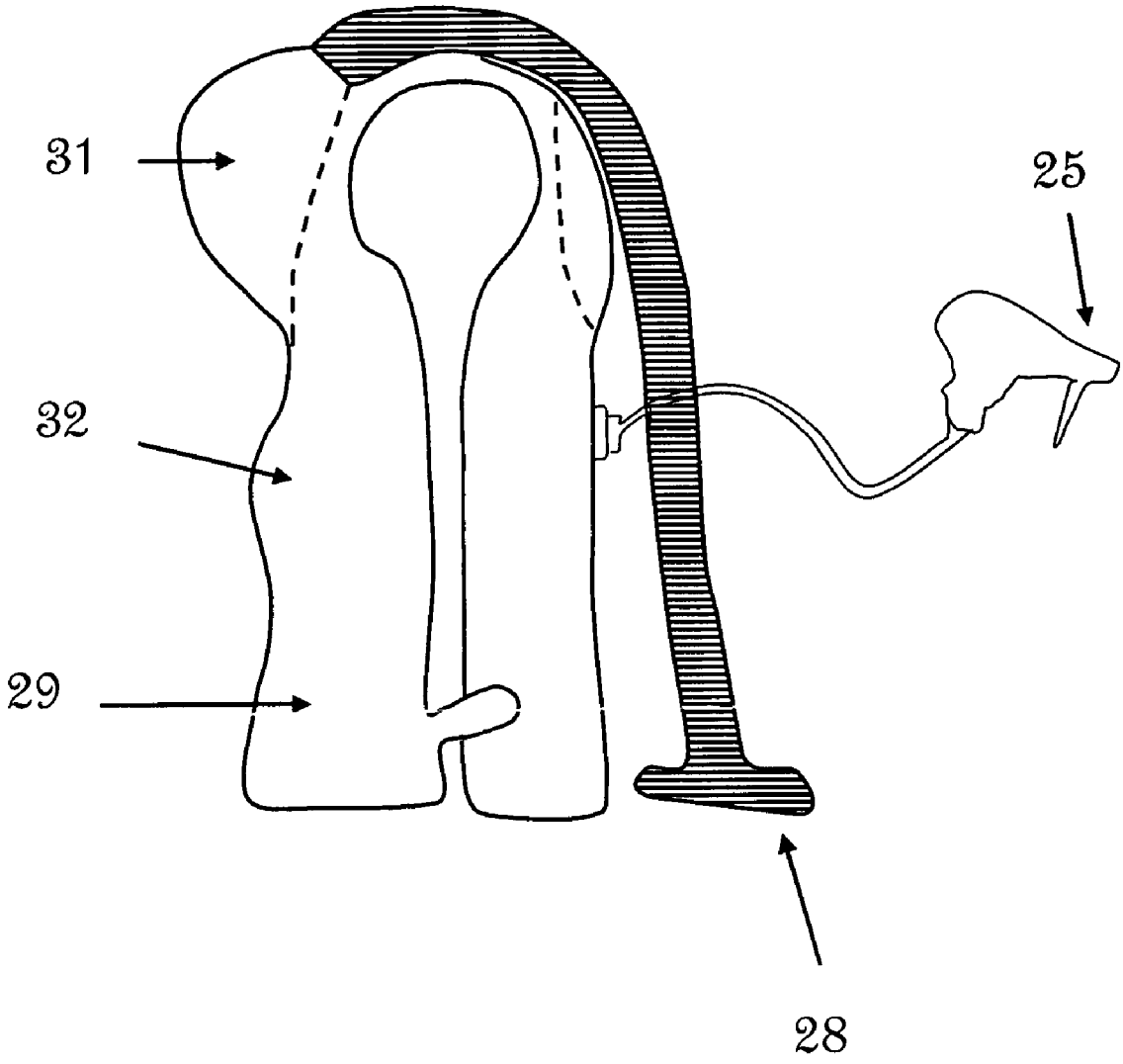
FIG. 2 Side view of the invention

Attachments (25). A variety of attachments can be connected via a simple snap or slide onto the dispensing hose to assist in scrubbing, sponging or swabbing, and including any cleaning activity associated with the surface cleaning. The spray head (25) can be made into the vacuum head (28) of the garment, or as depicted in FIGS. 1 and 2, can be separate.

Wet and dry vacuum (31). A battery operated or electrical wet and dry vacuum mechanism is attached to the garment to remove used cleaning solutions after the cleaning process has occurred.

Waste solution reservoir (32). The garment contains a waste solution reservoir that is attached to the wet and dry vacuum (31) to collect and hold liquid and solid waste until it is convenient to dispose of it.

I claim:

1. A wearable garment containing devices to deliver, remove, and store wet and dry solutions, comprising:

a. bladder reservoirs mounted to said wearable device to contain the solutions;

b. a selector dial functioning as a conduit allowing to choose one or more solution;

c. a mechanism mounted to said wearable device to produce a vacuum under wet and dry conditions.

2. The wearable device of claim 1, further comprising removable cleaning attachments.

* * * * *